US006640594B1

(12) United States Patent
Yao

(10) Patent No.: US 6,640,594 B1
(45) Date of Patent: Nov. 4, 2003

(54) ELECTRONIC LOCK

(75) Inventor: Celina Yao, Nan Tou Hsien (TW)

(73) Assignee: Shyang Feng Electric & Machinery Co., Ltd., Nan Tou Hsien (TW)

( * ) Notice: Subject to any disclaimer, the term of this patent is extended or adjusted under 35 U.S.C. 154(b) by 0 days.

(21) Appl. No.: 10/197,445

(22) Filed: Jul. 18, 2002

(51) Int. Cl.[7] ..... E05B 47/00

(52) U.S. Cl. ..... 70/277; 70/223; 70/278.1; 70/279.1; 70/472

(58) Field of Search ..... 70/218, 219, 220, 70/221, 222, 223, 224, 277, 278.1, 278.2, 278.3, 278.4, 278.5, 278.6, 278.7, 279.1, 280, 281, 282, 283, 283.1, 422, 472; 292/144

(56) References Cited

U.S. PATENT DOCUMENTS

| | | | | | |
|---|---|---|---|---|---|
| 3,922,896 | A | * | 12/1975 | Kagoura | 70/223 |
| 4,956,984 | A | * | 9/1990 | Chi-Cheng | 70/277 |
| 5,040,391 | A | * | 8/1991 | Lin | 70/277 |
| 5,372,025 | A | * | 12/1994 | Lin | 70/472 |
| 5,421,178 | A | * | 6/1995 | Hamel et al. | 70/283 |
| 5,475,996 | A | * | 12/1995 | Chen | 70/279.1 |
| 5,782,118 | A | * | 7/1998 | Chamberlain et al. | 70/278.3 |
| 5,868,018 | A | * | 2/1999 | Kang | 70/472 |
| 5,960,656 | A | * | 10/1999 | Yao | 70/472 |
| 6,145,353 | A | * | 11/2000 | Doucet | 70/277 |
| 6,351,976 | B1 | * | 3/2002 | Chen | 70/224 |
| 6,460,903 | B1 | * | 10/2002 | Ming-Chih | 292/172 |

FOREIGN PATENT DOCUMENTS

GB 2211239 A * 6/1989

* cited by examiner

*Primary Examiner*—Anthony Knight
*Assistant Examiner*—Michael J. Kyle
(74) *Attorney, Agent, or Firm*—Rosenberg, Klein & Lee

(57) ABSTRACT

An improved electronic lock requires a low power and consumes less electricity including an outer frame, an inner frame, a lock axle unit and a power unit. The outer frame is fastened to the outer side of a lock stile of a door. The outer frame has an outer handle, a keypad and a key way located on the exterior, and has the interior for housing the lock axle unit and the power unit to couple with the inner frame. The power unit includes a motor, a spring, a sleeve, a sliding plate and a retain plate. The power unit is coupled with a L-shaped lever to generate lever movements. Users may enter an electronic password to activate the motor to perform locking and unlocking function. The construction greatly reduces electric power: consumption of batteries, and lowers electric voltage, and increase the durability of the batteries.

1 Claim, 8 Drawing Sheets

ELECTRONIC LOCK

BACKGROUND OF THE INVENTION

1. Field of the Invention

The invention relates to an improved electronic lock and particularly an improved electronic lock that employs a small power motor to drive the lock to reduce electric power consumption and voltage, and to increase the durability of batteries.

2. Description of the Prior Art

Conventional electronic locks generally employ only an electronic password to control unlocking of the lock. Such a design has many drawbacks in practical use, notably:

1. As the electronic lock controls unlocking and locking mainly through electronics, and it generally does not have keys for backup, in the event of power shortage, malfunction of electric circuits, or users forget the password, users cannot unlock the electronic lock by themselves. They have to ask the locksmith for help. It is not convenient and incurs extra cost.
2. Conventional electronic locks do not have well designed battery chambers. In the event of battery power running out, the whole electronic lock has to be disassembled for replenishing the batteries. It is not only inconvenient, parts (such as screws) are easily get lost during disassembly. In addition, electric circuits are easy to be damaged due to inadvertent disassembly.

In order to remedy the disadvantages mentioned above, Applicant has proposed a solution entitled: "Improved electronic lock" (U.S. Pat. No. 5,960,656). Although that patent can overcome the problems of conventional electronic locks, it uses solenoid valve as the main driving source. Such a design creates the following problems:

1. The operation of the solenoid valve requires sufficient electric power to generate the required magnetic force. When using batteries as the power supply for the electronic lock, the electric power of the batteries is consumed continuously. Hence its reliability is risky.
2. The solenoid valve requires electric power of 12V, and a step-up circuit is needed to boost the voltage from 12V to 50V. It consumes a lot of electric power.

SUMMARY OF THE INVENTION

In view of aforesaid disadvantages, the object of the invention is to provide an improved electronic lock that employs a motor as the power supply. The motor can function accurately at a low voltage, thus effectively overcomes the disadvantages of power draining that occurs to the solenoid valve. And durability of the batteries also increases.

The electronic lock according to the invention mainly includes an outer frame, an inner frame, a lock axle unit and a power unit.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
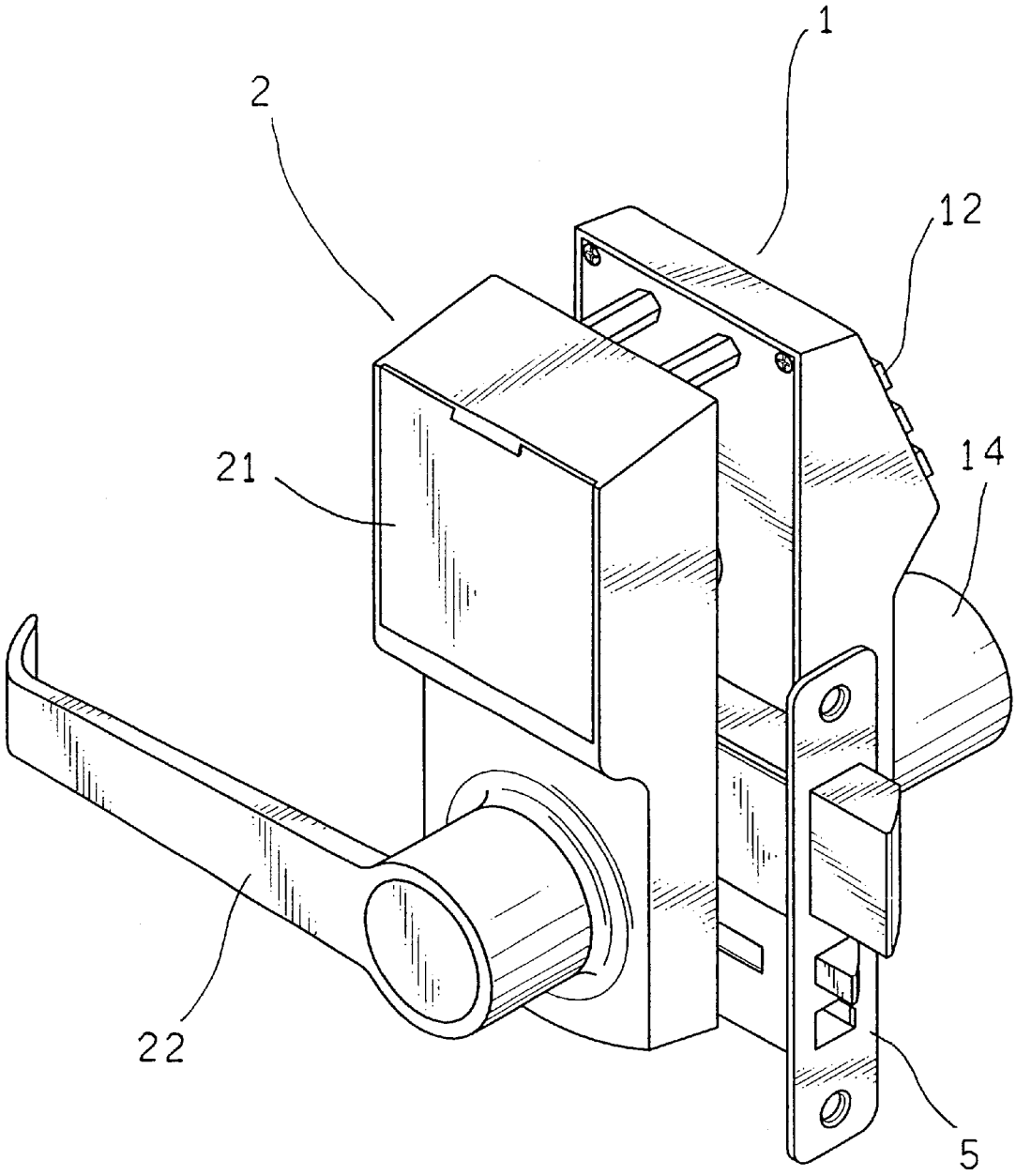
FIG. 1 is a perspective view of the invention.
Figure 2:
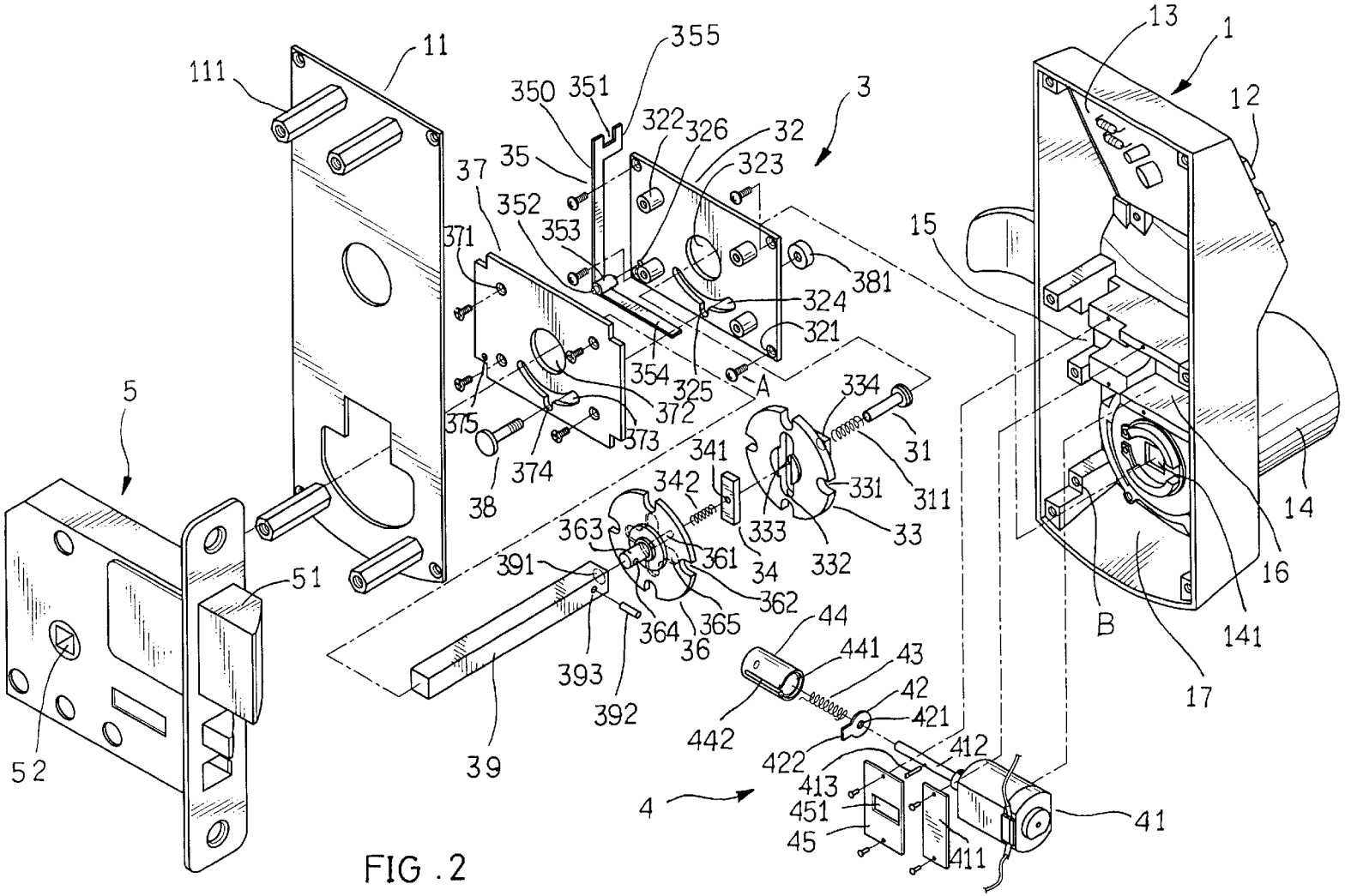
FIG. 2 is an exploded view of the invention.

Referring to FIGS. 1 and 2, the electronic lock of the invention mainly includes an outer frame 1 fastening to a locking dock 11. The locking dock 11 has screw struts 111 located on one side to run through the lock stile from the outer side of a door to fasten to an inner frame 2 of the lock located on the inner side of the door.

The outer frame 1 includes a keypad 12, a circuit board 13 located in the interior of the keypad 12, and an outer handle 14 located on a lower section thereof. The outer handle 14 houses a lock core 19 therein (also referring to FIG. 8) and has a shaft opening 141 for coupling with a front rod 31 and a stub 334 of a front connection disc 33 of a lock axle unit 3, and is movable therewith. In the interior of the outer frame 1 below the circuit board, there are a barrel seat 15, a motor seat 16 and a lock axle compartment 17 for housing a power unit 4 and the lock axle unit 3.

The inner frame 2 is installed on the inner side of the lock stile of the door, and has a battery chamber 211 located on an upper side for housing batteries and an inner handle 22 for users to control extension and retraction of the latch bolt 51 of a latch assembly 5.

The invention has the following characteristics:

The lock axle unit 3 is housed in the lock axle compartment 17 of the outer frame 1, and includes:

- a front rod 31 coupling with a first spring 311 and running through a front retain plate 32 and a first round opening 333 of the front connection disc 33, and having one end movable forwards when pressed by an inserting key and other end pushing a linkage block 34;
- a front retain plate 32 being fastened to the outer frame 1 by coupling screw bolts A through apertures 321 formed thereon with screw holes B located on the outer frame 1. The front retain plate 32 has at least one strut 322 for fastening to a rear retain plate 37 through screw bolts A. In the center of the front retain plate 32, there is a second round opening 323 to allow a stub 334 located on the front connection disc 33 to run through. Below the second round opening 323, there is a first arched slot 324 which has a first notch 325 located on the bottom rim in the middle thereof. On the left and lower corner of the front retain plate 32, there is a hole 326 pivotally engaging with a stub shaft 352 of a coupling barrel 353 of a L-shaped lever 35;
- a front connection disc 33 having four first grooves 331 formed on the perimeter thereof and an indented straight trough 332 formed in the center of the front side. The first round opening 333 is formed on the bottom of the trough 332 to communicate with the stub 334 located on other side of the front connection disc 33;
- a linkage block 34 having an aperture 341 formed in the center thereof to allow a pintle 361 located on a rear connection disc 36 to pass through. The linkage block 34 is pressed by a second spring 342 in normal conditions to wedge in the straight trough 332 of the front connection disc 33;

a L-shaped lever 35 being located between the front retain plate 32 and the rear retain plate 37, and having a vertical section 350 and a bottom section 354. The L-shaped lever 35 further has a coupling barrel 353 located at the corner with two ends formed respectively a stub shaft 352 to engage respectively with the hole 362 on the front retain plate 32 and another hole 375 formed on the rear retain plate 37 such that the L-shaped lever 35 is turnable about a constant axis. The top end of the vertical section 350 is extended to form an U-shaped fender 355 which has a notch 351 to allow the spindle 412 of a motor 41 to pass through;

a rear connection disc 36 having four second grooves 362 formed on the perimeter thereof and a cylindrical strut 363 located in the center of the front side. The cylindrical strut 363 has an aperture 364. The cylindrical strut 363 may couple with a coupling hole 391 formed in a linkage rod 39 which has an aperture 393 formed on one end thereof, then a pin 392 may be inserted into the hole 393 and the aperture 364 to fasten the rear connection disc 36 to the linkage rod 39. The rear connection disc 36 further has a cross straight trough 365 corresponding to the straight trough 332 of the front connection disc 33. The pintle 361 is located in the center of the cross straight trough 365 for passing through the aperture 341 formed on the linkage block 34;

a rear retain plate 37 having apertures 371 for fastening to the struts 322 of the front retain plate 32 by means of the screw bolts A to couple with the front retain plate 32. The rear retain plate 37 has a third round opening 372 and a second arched slot 373 located below the third round opening 372. The second arched slot 373 has a second notch 374 located on the bottom rim in the middle thereof. On the left and lower corner of the rear retain plate 37, there is another hole 375 pivotally engaging with the stub shaft 352 of the coupling barrel 353 of the L-shaped lever 35;

a latch bolt 38 running through the arched slots 324 and 373 of the front and the rear retain plates 32 and 37 and is fastened to a nut 381 so that the latch bolt 38 may slide to the left and the right in the arched slots 324 and 373, and move the front and the rear connection discs 33 and 36. The latch bolt 38 is located in the notches 325 and 374 of the arched slots 324 and 373 in normal conditions; and a linkage rod 39 having a coupling hole 391 formed on one end thereof to couple with the cylindrical strut 363 of the rear connection disc 36 and is fastened by the pin 392, and other end running through a square opening 52 of the latch assembly 5 to engage with the inner handle 22 to link the movement between the latch bolt 51 of the latch assembly 5 and the inner handle 22 of the inner frame 2;

The power unit 4 is housed in the barrel seat 15 and the motor seat 16 of the outer frame 1, and includes:

a motor 41 being housed in the motor seat 16 of the outer frame 1 and fastened by a lid 411. The spindle 412 of the motor 41 may turn in one direction or in a reverse direction depending on the polarity of the input electric power supply. Therefore a pintle 413 mounted on the spindle 412 may move along the helical path of a third spring 43 housed in a sleeve 44 to move the sleeve forwards or rearwards;

a sliding plate 42 coupled an opening 441 of the sleeve 44 to prevent the third spring 43 from dropping out having a round hole 421 in the center to allow the spindle 412 of the motor 41 to pass through, and a jutting flap 422 extended from one side thereof to wedge in a retain slot 451 formed on a retain plate 45;

a third spring 43 housed in the sleeve 44 having two ends engaged with a wedge slot 442 of the sleeve 44;

a sleeve 44 being hollow for housing the third spring 43 and having a wedge slot 442 formed on one side thereof; and a retain plate 45 fastened to an upper section of the barrel seat 15 of the outer frame 1 to cover the sleeve 44. The retain plate 45 has a retain slot 451 for limiting the forward and rearward moving displacement of the jutting flap 422 of the sliding plate 42.

Figure 3:
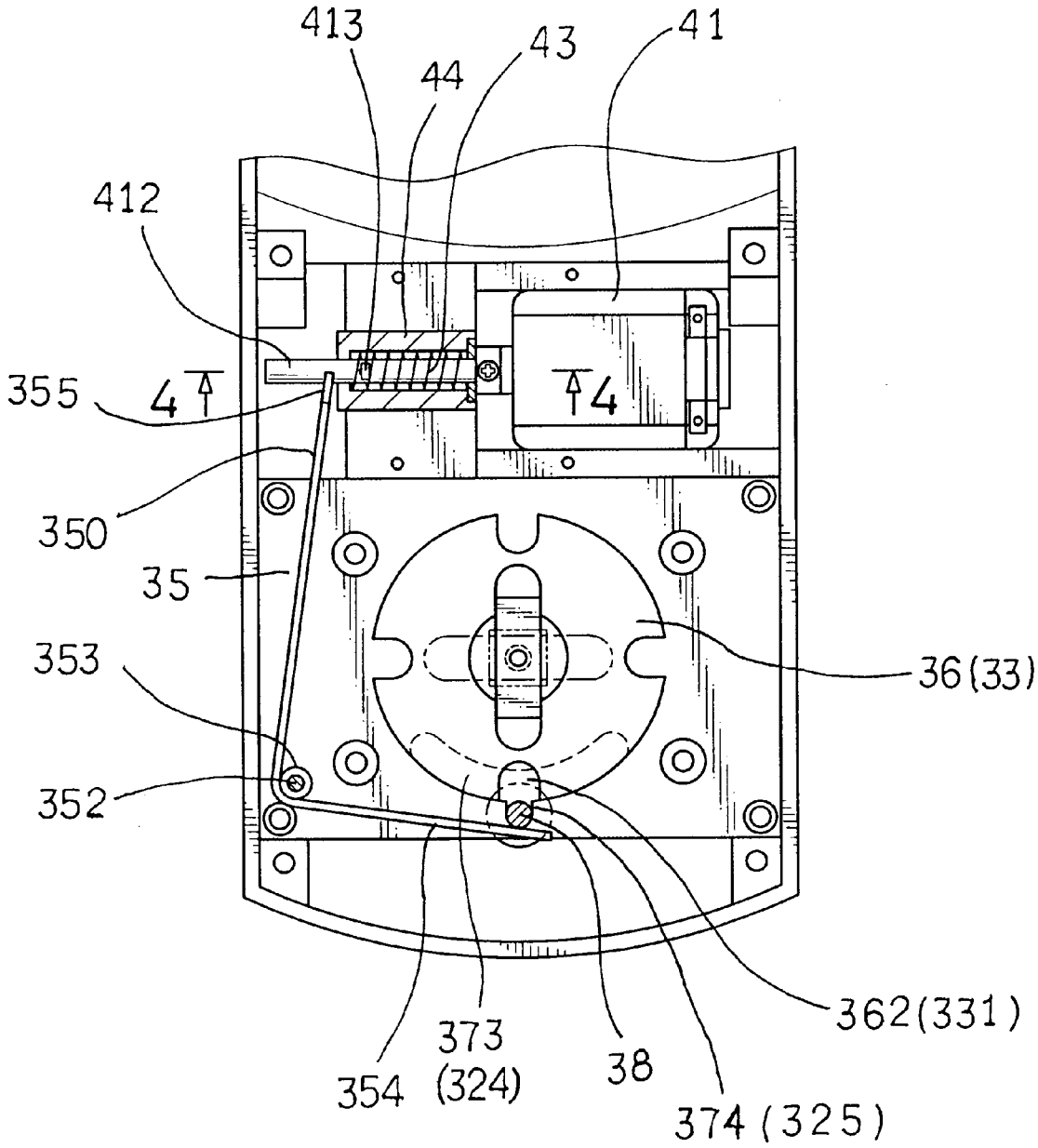
FIG. 3 is a schematic view of the invention in an operating condition, locked in a normal circumstance.
Figure 6:
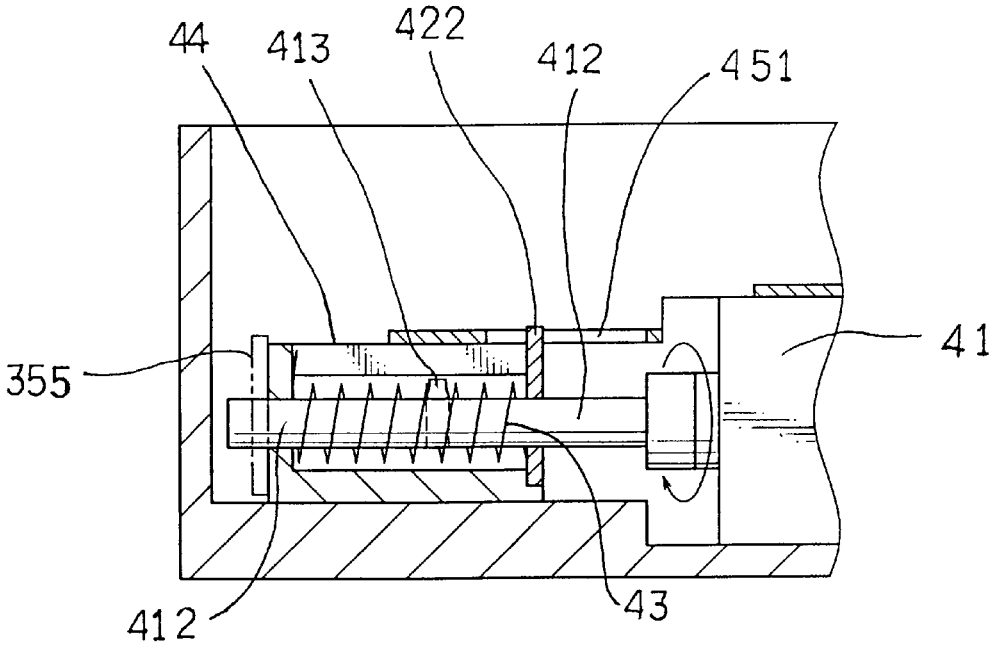
FIG. 6 is a fragmentary cross section according to FIG. 5.
Figure 4:
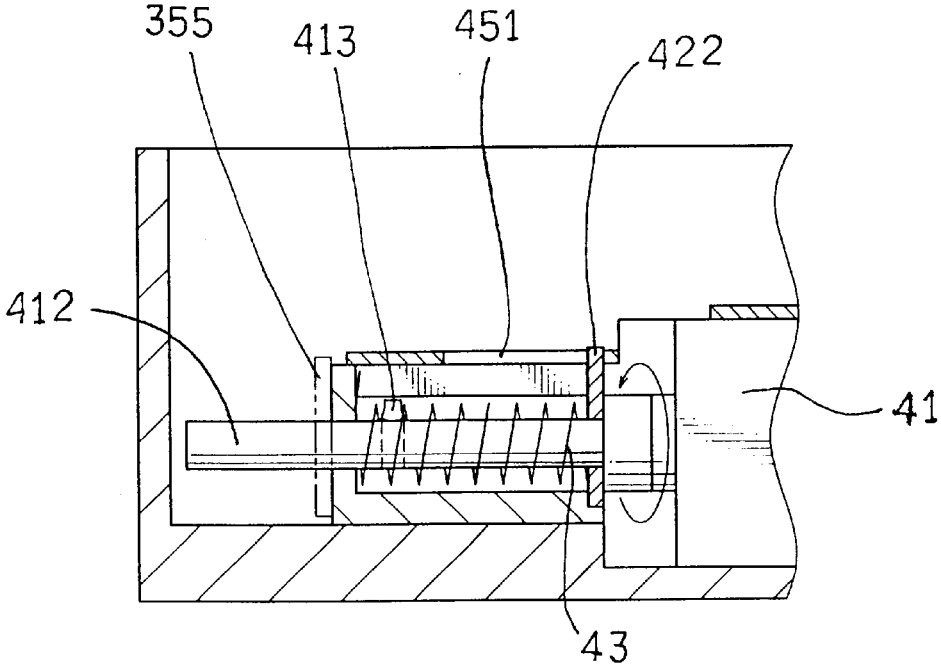
FIG. 4 is a fragmentary cross section according to FIG. 3.
Figure 5:
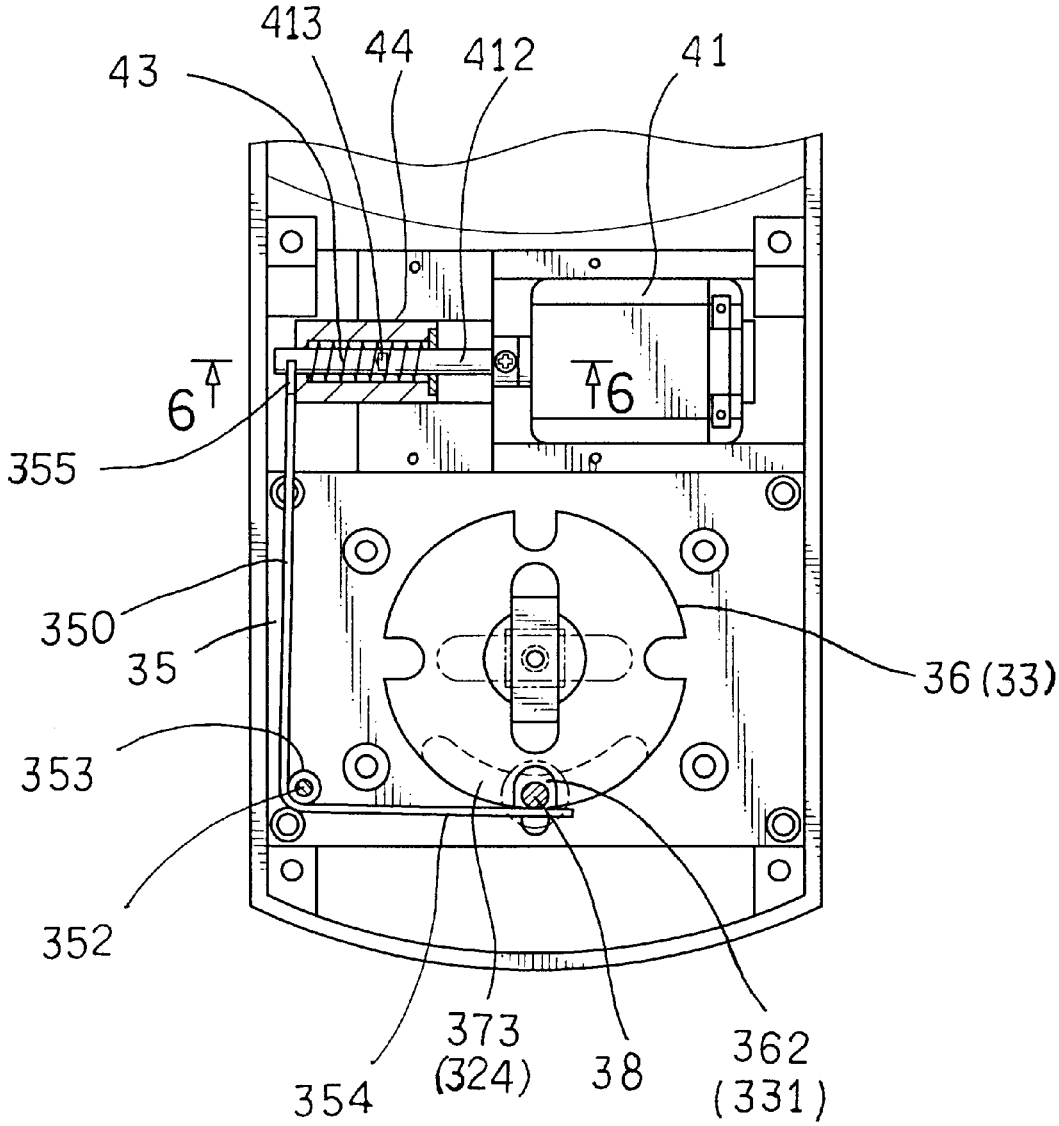
FIG. 5 is a schematic view of the invention in another operating condition, for unlocking.
Figure 7:
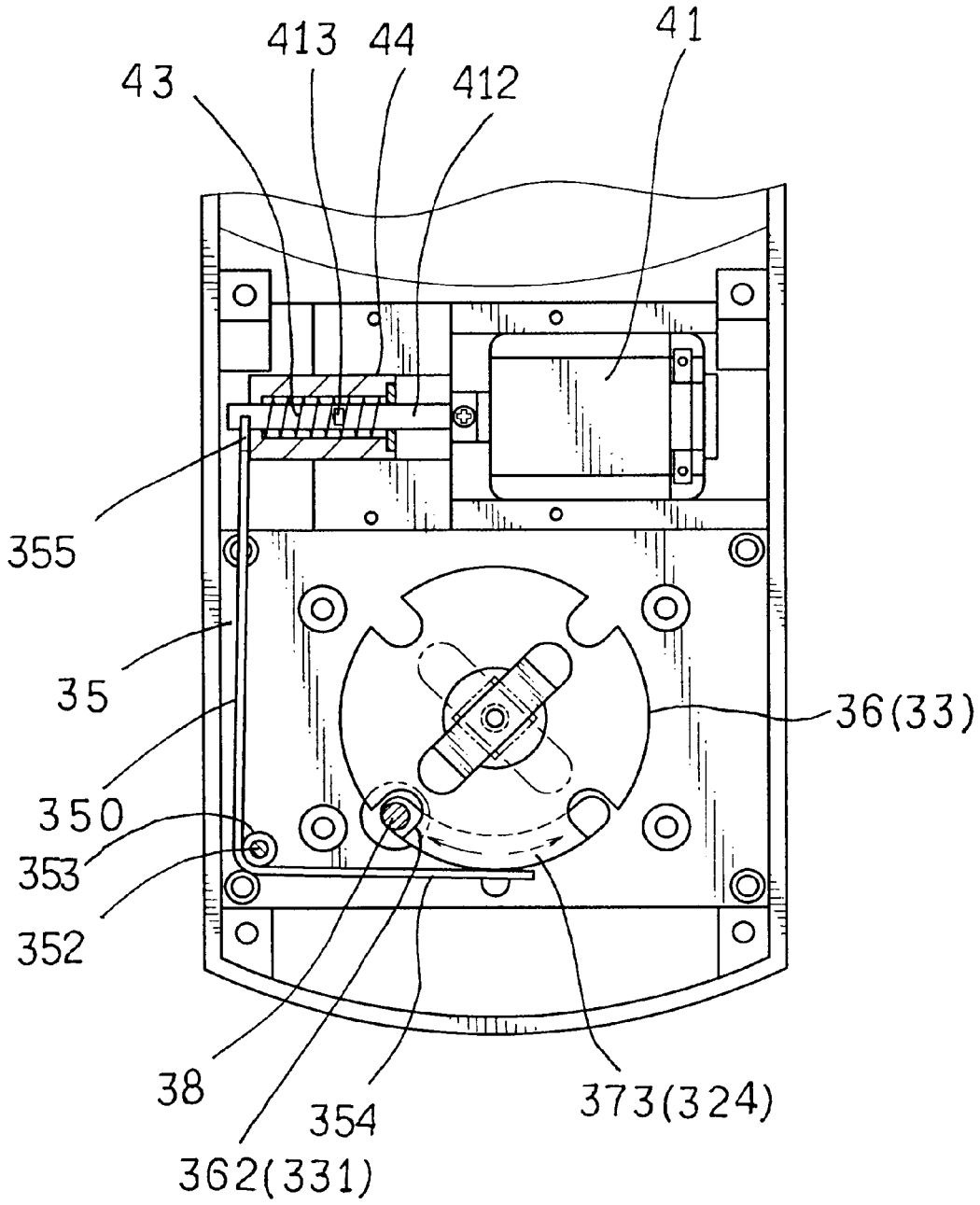
FIG. 7 is a schematic view of the invention in yet another operating condition, for unlocking.
Figure 8:
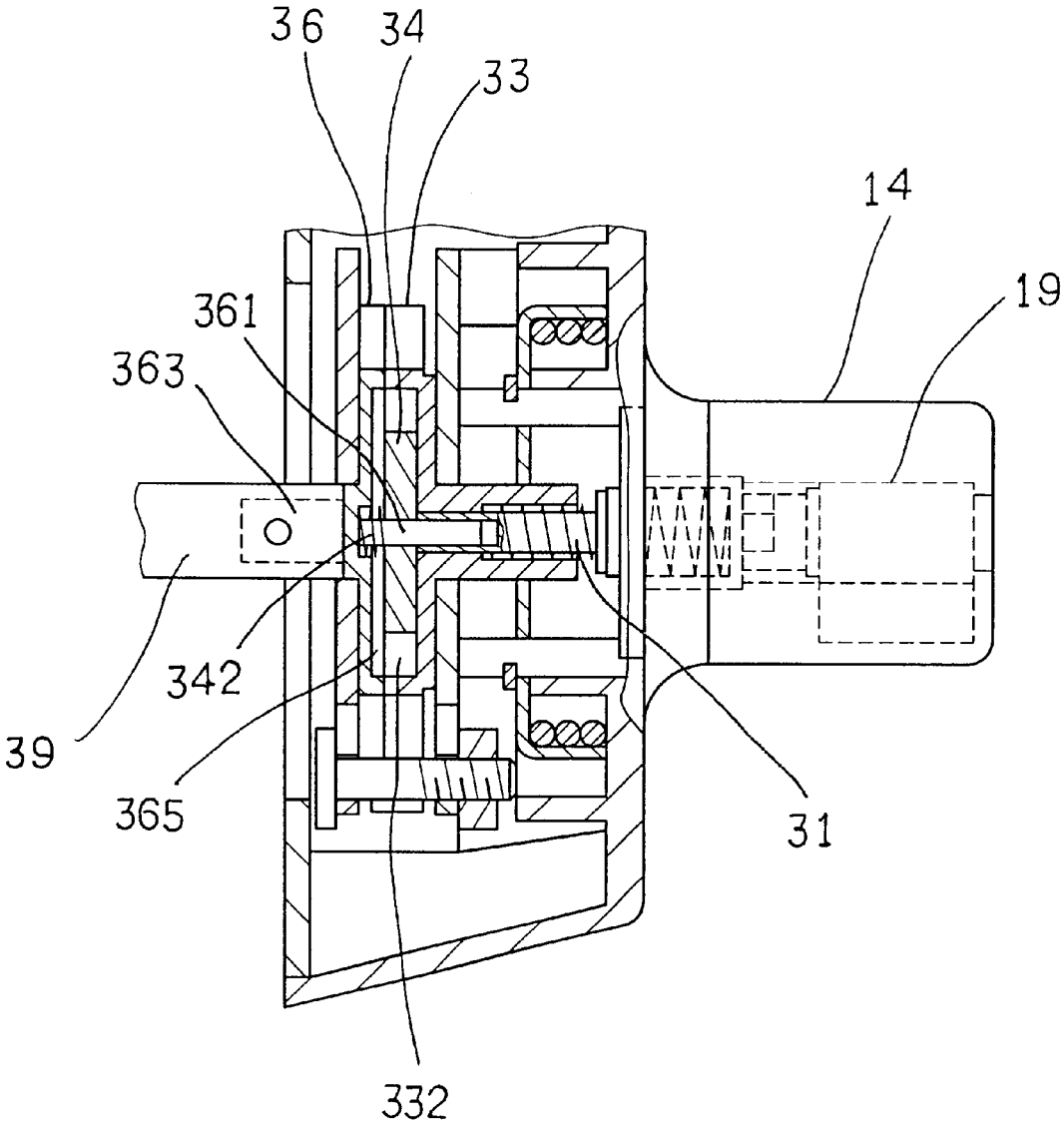
FIG. 8 is a cross section of the invention, showing locked in a normal circumstance.

By means of the construction set forth above, referring to FIGS. 3, 4 and 8, when the electronic lock of the invention is locked in normal conditions, the linkage block 34 of the lock axle unit 3 is pushed by the second spring 342 in the normal conditions and is wedged in the straight trough 332 of the front connection disc 33, and the latch bolt 38 drops into the notches 325 and 374 of the arched slots 324 and 373 of the front and the rear retain plates 32 and 37 due to gravity. Thus when an user turns the outer handle 14 of the outer frame 1, only the front connection plate 33 of the lock axle unit 3 is driven. The rear connection plate 36, linkage rod 39 and the latch bolt 51 of the latch assembly 5 cannot be moved. The electronic lock of the invention cannot be unlocked and is in a locked condition. To unlock the electronic lock of the invention, users may enter the correct password on the keypad 12 on the outer frame 1 to activate the circuit board 13, and the motor 41 of the power unit 4 is activated and rotates. As the spindle 412 of the motor 41 rotates at a constant location and the sleeve 44 is movable, when the pintle 413 of the spindle 412 rotates along the helical path of the spring 43, the sleeve 44 is pushed forwards. The U-shaped fender 355 of the L-shaped lever 35 is pushed by front end of the sleeve 44 (as shown in FIG. 6) and moved outwards. As a result, the bottom section 354 is tilted upwards to push the latch bolt 38 upwards into the arched slots 373 and 324, and the grooves 331 and 362 of the front and rear connection plates 33 and 36 (as shown in FIG. 5). In such a condition, when the user turns the outer handle 14 of the outer frame 1, the front and rear connection plates 33 and 36 and the linkage rod 39 of the lock axle unit 3 are driven to move the latch bolt 51 of the latch assembly 5, and the lock may be unlocked and opened (as shown in FIG. 7).

Figure 9:
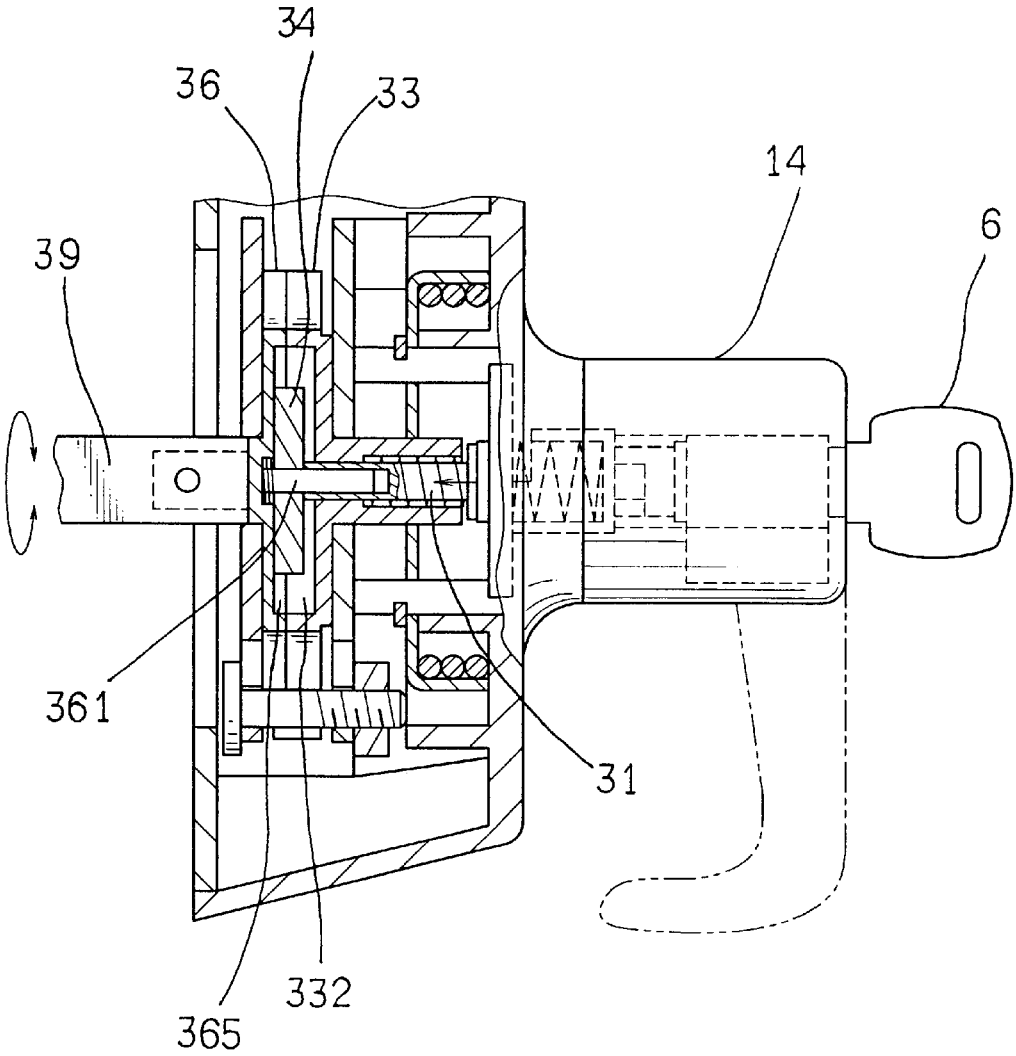
FIG. 9 is a cross section of the invention, showing an unlocking circumstance.

In the event that the user has forgotten the password or battery power in the electronic lock is exhausted, and the electronic lock cannot be activated, the user may insert the key 6 into the key way (as shown in FIGS. 8 and 9) to push the front rod 31 of the lock axle unit 3. The linkage block 34 may be pushed and moved between the straight trough 332 of the front connection disc 33 and the cross straight trough 365 of the rear connection disc 36 of the lock axle unit 3. Then the outer handle 14 of the outer frame 1 may be turned to drive the front and the rear connection discs 33 and 36, and in turn to drive the linkage rod 39 and the latch bolt 51 of the latch assembly 5 to accomplish the unlocking (operations of inserting the key into the key way are known in the art, thus are omitted in the drawings and descriptions).

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

I claim:

1. An improved electronic lock, comprising:

an outer frame fastening to a locking dock which has screw struts located on one side thereof to run through a lock stile from an outer side of a door for fastening to an inner frame located on an inner side of the door; wherein:

the outer frame includes a keypad, a circuit board located in the interior of the keypad and an outer handle located on a lower section thereof, the outer handle housing therein a lock core and a shaft opening for coupling with a front rod and a stub of a front connection disc of a lock axle unit, and being movable therewith, the outer frame further having a barrel seat, a motor seat and a lock axle compartment below the circuit board for housing a power unit and the lock axle unit; and the inner frame is installed on the inner side of the lock stile of the door, and has a battery chamber located on an upper section for housing batteries and an inner handle located on a lower section thereof for users to control extension and retraction of a latch bolt of a latch assembly;

wherein:

the lock axle unit is housed in the lock axle compartment of the outer frame and includes:

the front rod coupling with a first spring and running through a front retain plate and a first round opening of the front connection disc, and having one end movable forwards when pressed by an inserting key and other end pushing a linkage block;

the front retain plate being fastened to the outer frame by coupling screw bolts through apertures formed thereon with screw holes located in the outer frame, the front retain plate having at least one strut for fastening to a rear retain plate through screw bolts, a second round opening formed in the center thereof to allow a stub located on the front connection disc to run through, a first arched slot located below the second round opening, the first arched slot having a first notch located on a bottom rim in the middle thereof, the left and lower corner of the front retain plate having a hole pivotally engaged with a stub shaft of a coupling barrel of a L-shaped lever;

the front connection disc having four first grooves formed on the perimeter thereof and an straight trough formed in the center of a front side thereof, the straight trough having a first round opening formed on the bottom thereof to communicate with the stub located on the other side of the front connection disc;

the linkage block having an aperture formed in the Center thereof to allow a pintle located on a rear connection disc to pass through, the linkage block being pressed by a second spring in normal conditions to wedge in the straight trough of the front connection disc;

the shaped lever being located between the front retain plate and the rear retain plate, and having a vertical section and a bottom section, the L-shaped lever further having the coupling barrel located at the corner with two ends thereof forming respectively the stub shaft to engage respectively with the hole on the front retain plate and another hole formed on the rear retain plate such that the L-shaped lever is turnable about a constant axis, the vertical section having a top end extended to form an U-shaped fender which has a notch to allow a spindle of a motor to pass through;

the rear connection disc having four second grooves formed on the perimeter thereof and a cylindrical strut located in the center of a front side thereof, the cylindrical strut having a hole and being coupled with a coupling hole formed in a linkage rod and fastened by a pin through the hole, the rear connection disc further having a cross straight trough formed on other side thereof corresponding to the straight trough of the front connection disc, the cross straight trough having a pintle located in the center thereof to pass through the aperture formed on the linkage block;

the rear retain plate having apertures for fastening to the struts of the front retain plate by means of screw bolts to couple with the front retain plate, the rear retain plate further having a third round opening and a second arched slot located below the third round opening, the second arched slot having a second notch located on the bottom rim in the middle thereof, the rear retain plate having another hole formed on a left and a lower comer to pivotally engage with the stub shaft of the coupling barrel of the L-shaped lever;

a latch bolt running through the first and the second arched slots of the front and the rear retain plates and being fastened to a nut such that the latch bolt being slidable to left and right in the first and the second arched slots to move the front and the rear connection discs, the latch bolt being located in the notches of the arched slots in normal conditions; and the linkage rod having a coupling hole formed on one end thereof to couple with the cylindrical strut of the rear connection disc and being fastened by the pin, and having other end running through a square opening of the latch assembly to engage with the inner handle to link movements between the latch bolt of the latch assembly and the inner handle of the inner frame; and the power unit is housed in the barrel seat and the motor seat of the outer frame, and includes:

a motor housed in the motor seat of the outer frame and fastened by a lid, the spindle of the motor being turnable in one direction or in a reverse direction according to the polarity of the input electric power supply such that a pintle mounted on the spindle being movable along the helical path of a third spring housed in a sleeve to move the sleeve forwards or rearwards;

a sliding plate coupled an opening of the sleeve to prevent the third spring from dropping out having a round hole in the center to allow the spindle of the motor to pass through, and a jutting flap extended from one side thereof to wedge in a retain slot formed on a retain plate;

the third spring housed in the sleeve having two ends engaged with a wedge slot of the sleeve;

the sleeve being hollow for housing the third spring and having a wedge slot formed on one side thereof; and the retain plate fastened to an upper section of the barrel seat of the outer frame to cover the sleeve having a retain slot for limiting forward and rearward moving displacement of the jutting flap of the sliding plate.

* * * * *